US007044339B1

(12) United States Patent
Kuo

(10) Patent No.: US 7,044,339 B1
(45) Date of Patent: May 16, 2006

(54) SHROUD COVER FOR FLUIDS PUMP DISPENSER

(76) Inventor: Roy Kuo, No.288, Chin-Chow St., Taipei (TW)

( * ) Notice: Subject to any disclaimer, the term of this patent is extended or adjusted under 35 U.S.C. 154(b) by 0 days.

(21) Appl. No.: 11/211,945

(22) Filed: Aug. 26, 2005

(51) Int. Cl.
*B67D 5/06* (2006.01)

(52) U.S. Cl. ..... 222/182; 222/321.9; 222/562

(58) Field of Classification Search ..... 222/182, 222/562, 321.9
See application file for complete search history.

(56) References Cited

U.S. PATENT DOCUMENTS 4,676,407 A * 6/1987 Rideout ..... 222/182
5,706,984 A * 1/1998 Tada et al. ..... 222/182
6,196,423 B1 * 3/2001 Erxleben ..... 222/182

* cited by examiner

*Primary Examiner*—Philippe Derakshani

(57) ABSTRACT

A shroud cover for a pump dispenser includes a space formed inside, an opening formed at the bottom and one side of the shroud cover to provide a shell on the top, and a tube cap extended from the other side of the shroud cover. The dustproof shroud cover is securely fitted on the pump dispenser by accommodating a button and a dispensing pump of the pump dispenser in the space to receive a nozzle of the button in the tube cap. Such that, the shell shields above a pressing surface of the button with a gap formed therebetween to prevent the dispensing pump from being actuated by unintentionally pressing on the button during shipping or storage.

5 Claims, 3 Drawing Sheets

A - A

B - B

SHROUD COVER FOR FLUIDS PUMP DISPENSER

BACKGROUND OF THE INVENTION

The present invention relates to a shroud cover for fluids pump dispenser, and in particular to a shroud cover fitted on a pump dispenser for dustproof purpose and to prevent the pump dispenser from being actuated unintentionally during shipping or storage.

Typically, some fluids pump dispensers are operated to produce a fine mist or an atomized spray, and others to dispense a quantity of product in a liquid, cream or paste form. The former are used for spraying liquid products such as pharmaceutical products, cosmetic products or perfume; the latter are used for dispensing lotions or cleaners. Conventional fluid pump dispenser includes a dispensing pump mounted at the top of a container with a closure. The pump dispenser further includes a button disposed on the top and a dip-tube extended from the bottom of the dispensing pump. As such, by pressing down on the button, the fluids filled in the container can be discharged from a nozzle of the pump dispenser.

Conventionally, a protective cap may be provided to cover on the nozzle. The protective cap is normally formed in a tube shape for use to prevent contamination on the nozzle because of dust or fluids leakage. Another example may provide a cap with a click to secure on the pump dispenser.

However, all conventional caps are used to cover merely on the nozzle to prevent dust. For above-mentioned pump dispensers, there is no any protective cover provided to shield the button. Therefore, when the button is unintentionally pushed during shipping or storage, the fluids filled in the container will be inevitably discharged to contaminate the nozzle and even the container or the pump dispenser itself. Moreover, the discharged fluid is wasted.

BRIEF SUMMARY OF THE INVENTION

The present invention is to provide a shroud cover for a pump dispenser for dustproof purpose and to prevent the pump dispenser from being actuated unintentionally during shipping or storage.

Accordingly, a shroud cover of the present invention includes a space formed inside, an opening formed at the bottom and one side of the shroud cover to provide a shell on the top, and a tube cap extended from the other side of the shroud cover. The dustproof shroud cover is securely fitted on the pump dispenser by accommodating a button and a dispensing pump of the pump dispenser in the space to receive a nozzle of the button in the tube cap. Such that, the shell shields above a pressing surface of the button with a gap formed therebetween to prevent the dispensing pump from being actuated by unintentionally pressing on the button during shipping or storage.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
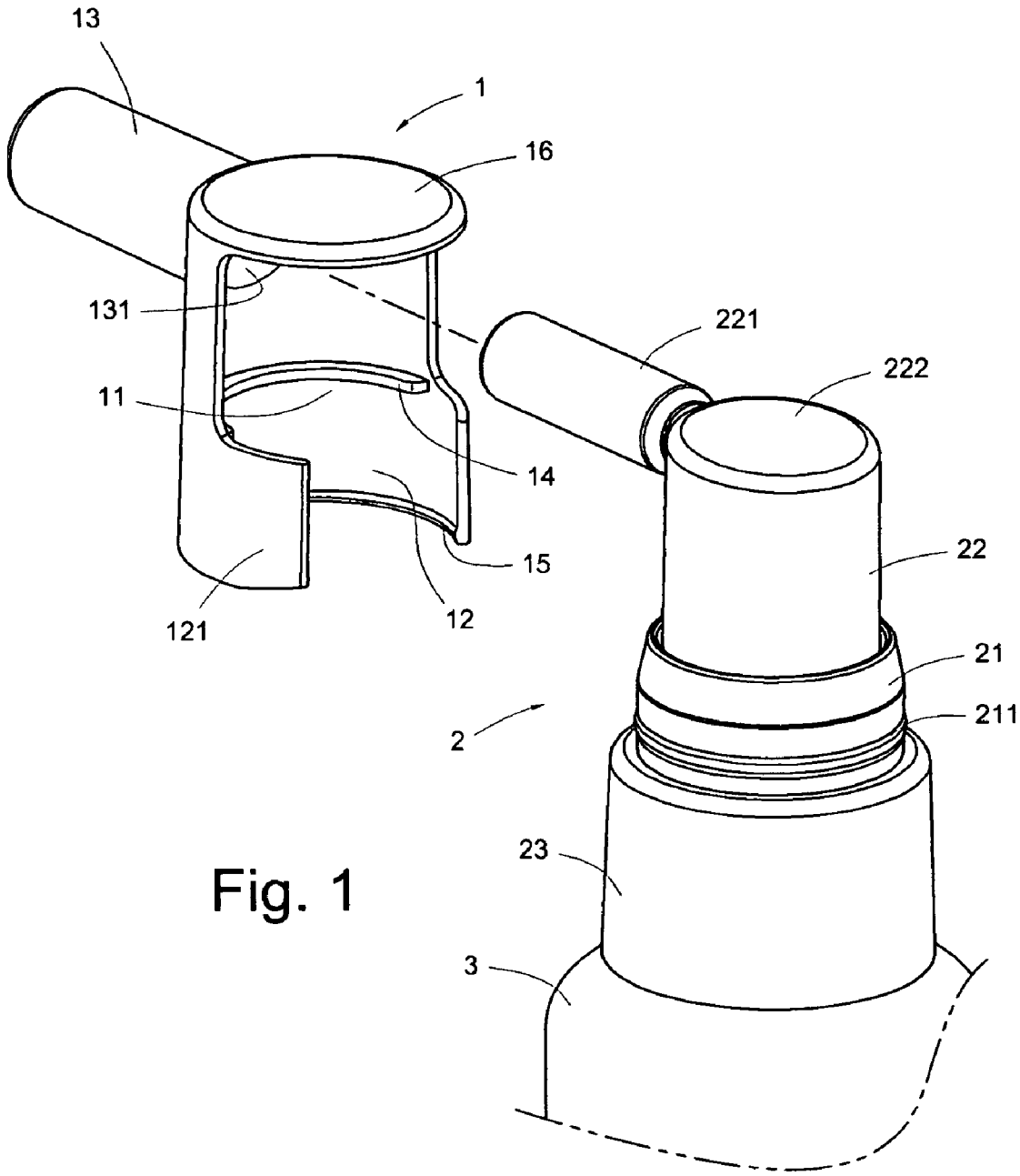
FIG. 1 is an exploded perspective view of a shroud cover and a pump dispenser of the present invention.
Figure 2:
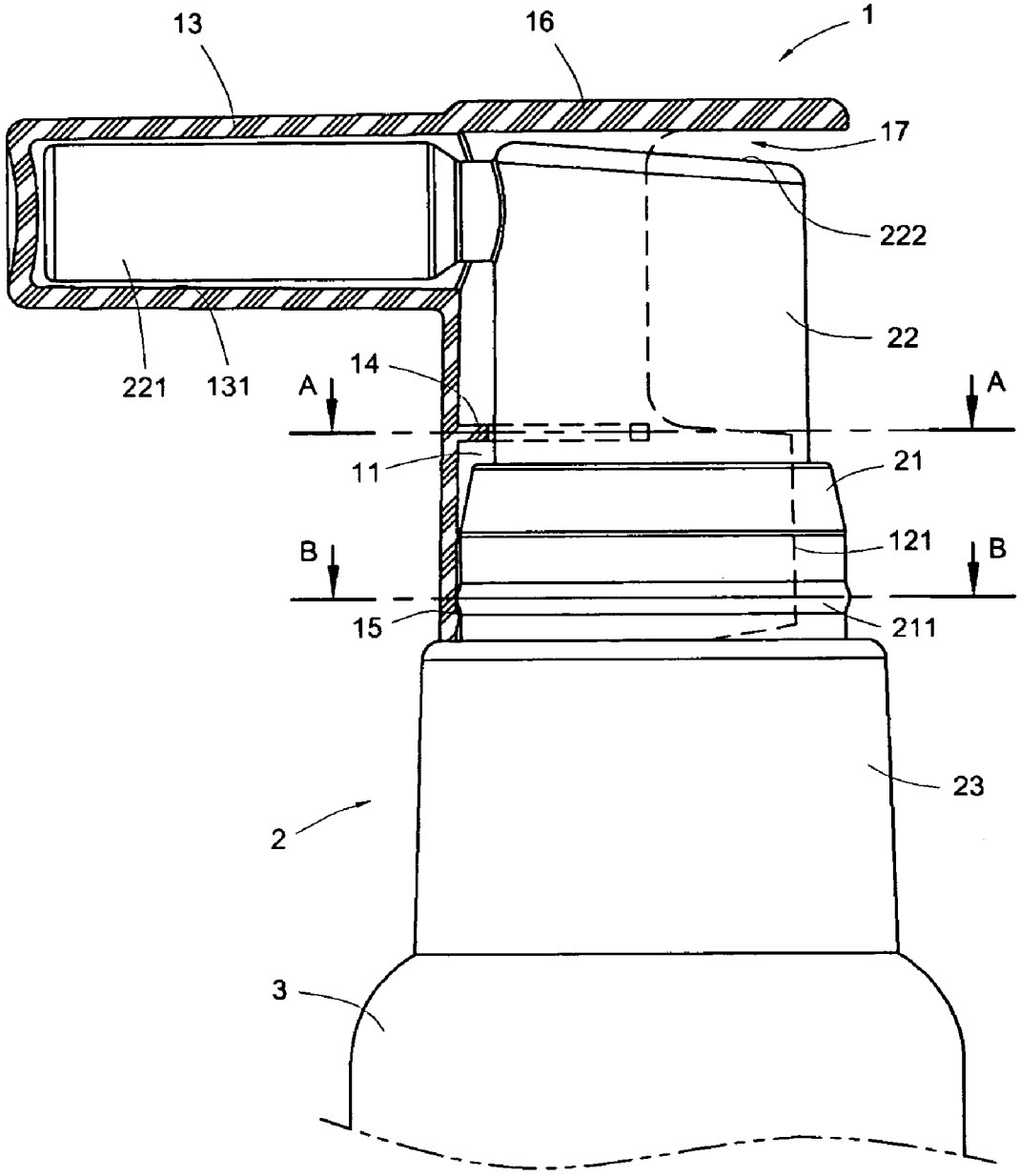
FIG. 2 is a cross sectional view of the shroud cover fitted on the pump dispenser.

Referring to FIG. 1, a shroud cover 1 of the present invention is fitted to a pump dispenser 2 which is mounted on a container 3 filled with fluids. The shroud cover 1 has a cross sectional view approximately in a C-shape as shown in FIG. 2.

The pump dispenser 2 includes a dispensing pump 21 and a button 22 disposed on the dispensing pump 21. A nozzle 221 is extended from a side of the button 22 and a pressing surface 222 is provided on the top of the button. The dispensing pump 21 includes a closure 23 to engage the container 3. Moreover, a rim 211 is formed on the dispensing pump 21.

The shroud cover 1 has a space 11 formed inside. An opening 12 is formed at the bottom and one side of the shroud cover 1 to provide a shell 16 on the top and two clamping portions 121 from both sides of the opening 12.

A tube cap 13 is extended from the other side of the shroud cover 1. A tube body 131 of the tube cap 13 has one open end connected to the space 11 of the shroud cover 1 and the other end being closed. Moreover, a flange 14 and a click 15 are formed on the inner wall of the shroud cover 1.

Figure 3:
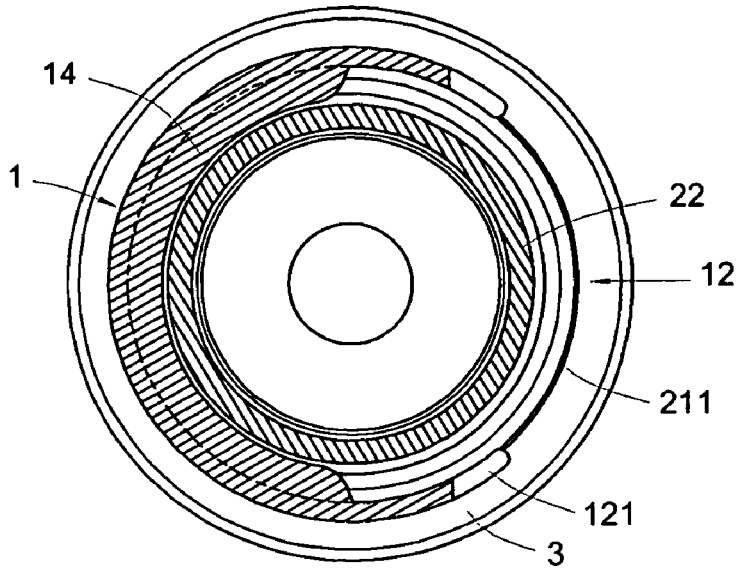
FIG. 3 is a cross sectional view along line A—A of FIG. 2, wherein a flange of the shroud cover is secured on a button of the pump dispenser.
Figure 4:
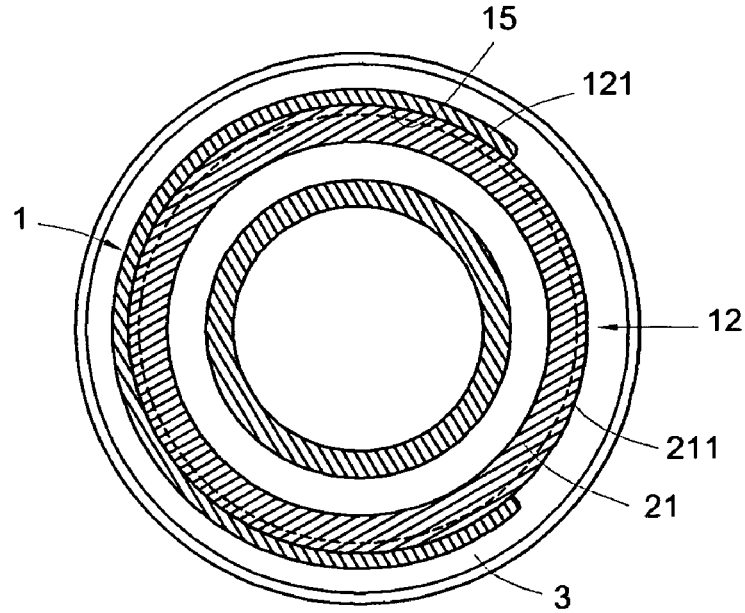
FIG. 4 is a cross sectional view along line B—B of FIG. 2, wherein a click of the shroud cover is secured on a rim of a dispensing pump of the pump dispenser.

Accordingly, as shown in FIG. 2, the dustproof shroud cover 1 is fitted on the pump dispenser 2 by accommodating the button 22 and the dispensing pump 21 in the space 11 to receive the nozzle 221 in the tube cap 13, and clamping on the dispensing pump 21 with the clamping portions 121. As shown in FIGS. 3 and 4, the flange 14 and the click 15 can respectively provide further grasping on the button 22 and the rim 211 of the dispensing pump 21 to secure the engagement of the shroud cover 1 with the pump dispenser 2. Such that, the shell 16 shields above the pressing surface 222, as shown in FIG. 2, with a gap 17 formed therebetween to prevent the dispensing pump 21 from being actuated by unintentionally pressing on the button 22 during shipping or storage.

The present invention is thus described; it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A shroud cover for a pump dispenser mounted on a container filled with fluids, the pump dispenser comprising a dispensing pump, a button disposed on the dispensing pump with a nozzle extended therefrom and a pressing surface formed on the top, and a closure to engage the container, the shroud cover comprising a space formed inside; an opening formed at the bottom and one side of the shroud cover to provide a shell on the top; and a tube cap extended from the other side of the shroud cover, wherein the shroud cover is securely fitted on the pump dispenser by accommodating the button and the dispensing pump in the space to receive the nozzle in the tube cap, and the shell shields above the pressing surface.

2. The shroud cover as claimed in claim 1, wherein two clamping portions are provided from both sides of the opening to clamp on the dispensing pump.

3. The shroud cover as claimed in claim 1, wherein a flange is formed on an inner wall of the shroud cover to grasp on the button.

4. The shroud cover as claimed in claim 1, wherein a click is formed on an inner wall of the shroud cover to grasp on a rim of the dispensing pump.

5. The shroud cover as claimed in claim 1, wherein a gap is formed between the shell and the pressing surface.

* * * * *